United States Patent [19]

Sonntag

[11] 4,030,139

[45] June 21, 1977

[54] PROTECTIVE APRON AND METHOD OF FABRICATION

[76] Inventor: Marvin A. Sonntag, Rte. 1, Green Lake, Wis. 54941

[22] Filed: Feb. 25, 1976

[21] Appl. No.: 661,215

[52] U.S. Cl. ..... 2/51

[51] Int. Cl.[2] ..... A41B 13/10

[58] Field of Search ..... 2/51, 46, 48; 36/4

[56] References Cited

UNITED STATES PATENTS

| | | | |
|---|---|---|---|
| 1,165,538 | 12/1915 | Pellant | 2/51 |
| 1,193,545 | 8/1916 | Hart | 2/51 |
| 2,130,682 | 9/1938 | Gruner | 36/4 |

FOREIGN PATENTS OR APPLICATIONS

| | | | |
|---|---|---|---|
| 190,704 | 7/1937 | Switzerland | 2/48 |
| 415,662 | 8/1934 | United Kingdom | 2/48 |

*Primary Examiner*—Alfred R. Guest

*Attorney, Agent, or Firm*—Joseph P. House, Jr.

[57] ABSTRACT

A protective apron has a fabric base sheet with an over-all plastic coating on which is superimposed a belly band completely across the apron from one side to the other. The belly band comprises a layer of substantially all-plastic superimposed on the plastic coating of the base sheet fabric and laminated thereto throughout the contiguous areas thereof.

1 Claim, 5 Drawing Figures

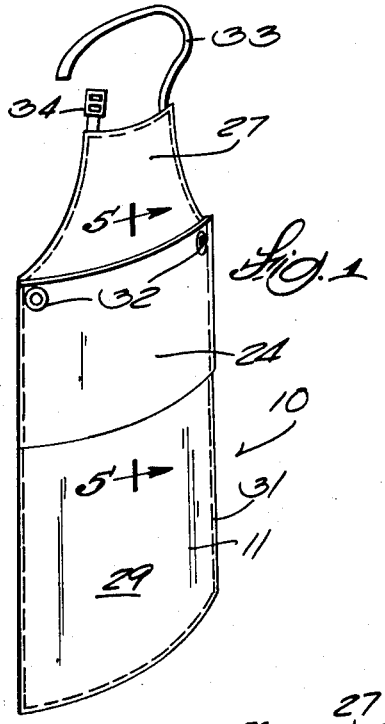
Fig. 1
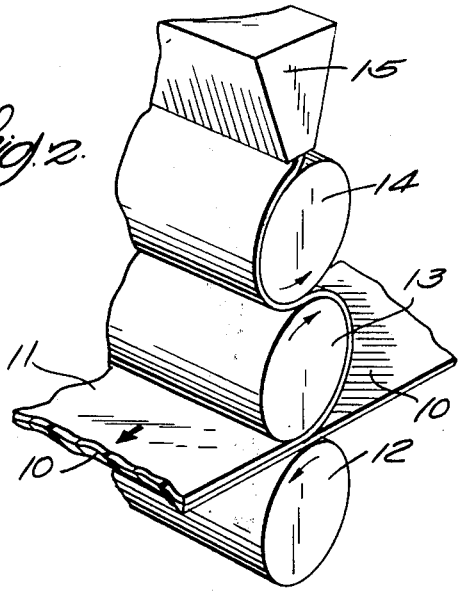
Fig. 2
Fig. 4
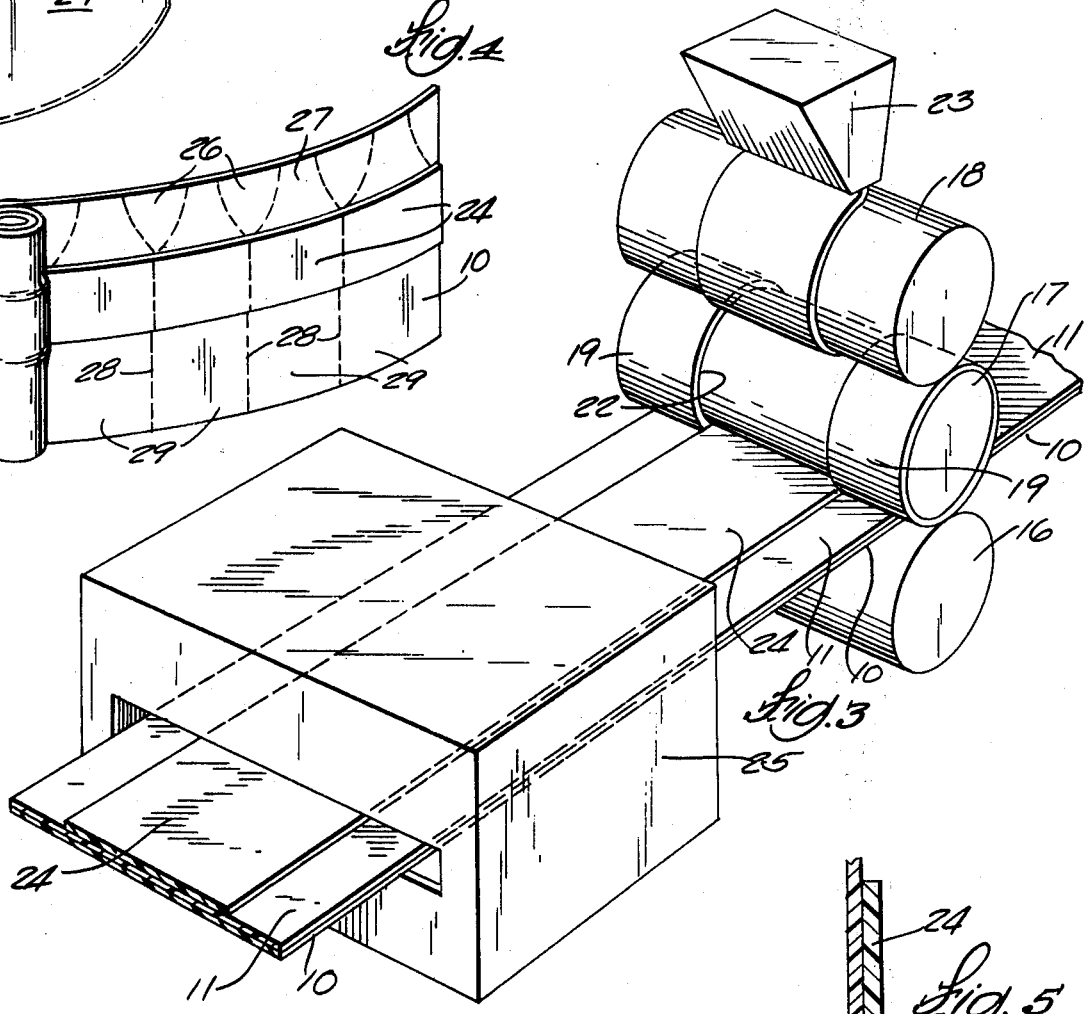
Fig. 3
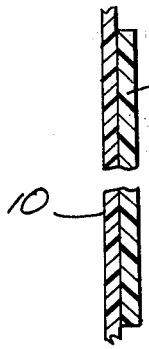
Fig. 5

PROTECTIVE APRON AND METHOD OF FABRICATION

BACKGROUND OF THE INVENTION

Protective fabric aprons coated with a relatively thin layer of plastic have heretofore been frequently provided with a sewn-on belly patch which typically comprises a plastic coated fabric piece of material of the same composition as the coated apron fabric. Such patch is intended to re-enforce the belly area of the apron for enhanced protection of the wearer. However, such aprons are subject to certain deficiencies, including:

1. The patch is no more durable than any other part of the apron because the patch consists simply of a thinly coated piece of fabric. After the thin plastic coating over the patch has worn through, the base fabric of the patch is exposed and the patch coating tends to delaminate because of the wicking action of oils, fat, blood, etc.
2. Because the thin coating on the patch is vulnerable to cutting and abrasion down to the base fabric of the patch, such fabric when exposed will readily absorb bacteria and contaminates, thus rendering the apron unsatisfactory for use in food and meat processing.
3. The re-enforcing patch is typically sewn or sealed to the apron only along certain edges, leaving other edges free. This forms a pocket open for dangerous snagging by the wearer, as well as for admission of dirt and foreign matter.
4. Although attempts have been made to completely seal, cement or otherwise vulcanize the patch over its entire area to the base apron, such patches frequently delaminate in whole or in part because the raw edge of the base fabric is exposed at the edge of the patch and the wicking action of moisture, blood, oils, etc., into the base fabric promotes blistering, delamination and peeling-back of the patch. Moreover, such patches are typically applied after the coated apron has been initially cured in ovens or dryers and the lamination of the patch to the apron is achieved by a cement which rarely satisfactorily completely bonds the previously cured materials together.

SUMMARY OF THE INVENTION

In accordance with the present invention, a top layer of relatively thick, all-plastic is superimposed on the plastic coated base sheet fabric and extends in a strip or band completely across the belly area of the apron from one side edge to the other. Thus the belly band does not itself contain any fabric but comprises a relatively thick layer of substantially solid or pure plastic which forms a toughprotective armour plate over the vulnerable belly area of the apron. This belly band plastic layer is superimposed onto the plastic coated base fabric before any curing has occurred. The band is laminated to the apron by heat sealing or vulcanizing it thereto at the same time that the plastic coating on the base fabric is heat sealed to the base fabric. Accordingly, an intimate and substantially permanent bond throughout the contiguous areas of the belly band and underlying apron is achieved.

The apron is fabricated in a technique in which a relatively wide web of base fabric is first coated over-all with a plastic coating and thereafter a second coating of substantially pure plastic is applied in a longitudinally extending, relatively thick band over the previously plastic coated web. The band is narrower than the web and is offset inwardly from the edges thereof. The composite web and band is then passed through a heater to heat seal or vulcanize the top layer of plastic to the plastic coating of the base fabric web throughout the contiguous areas thereof, at the same time that the plastic coating is sealed to the fabric web. The composite sheet may then be die-cut along one edge and at one side of the belly band to form bib portions of the aprons and the web is then severed at spaced intervals longitudinally of the web into separate aprons.

The resultant apron has a solid or substantially pure belly band of thick, tough plastic which provides an armour plate and is not subject to becoming loose or to peel or to collect dirt and grease, as do the patches of the prior art.

Other objects, features and advantages of the invention will appear from the disclosure hereof.

DESCRIPTION OF THE DRAWINGS

FIG. 1 is a plan view of an apron embodying the invention.

FIG. 2 is a diagrammatic view illustrating one step in the fabrication of the apron.

FIG. 3 is a diagrammatic perspective view illustrating a succeeding step in the fabrication of the apron.

FIG. 4 is a top view of the fabric web to which the various coatings and score lines have been applied in the course of fabricating the apron.

FIG. 5 is an enlarged fragmentary cross section taken along the line 5—5 of FIG. 1.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

The protective apron of the present invention is intended as a protective and safety industrial apron which protects the wearer against abrasion, acids, fats, heat, chemicals, greases, oils, solvents, etc. It is utilized in many environments, for example, by workers in the poultry and food processing industries, meat packing, foundry, forging and welding operations, nuclear and clean room environments, etc.

The finished apron shown in FIG. 1 comprises a base sheet or web 10 consisting of the fabric or cloth base. This fabric is usually a cotton sheeting or drill. However, it can be a synthetic fabric material such as nylon, dacron, rayon, fiberglass or blends of these materials. The fabric web 10 is impregnated or coated with a plastic material 11. The term "plastic" is used herein generically to apply to any of the usual elastomeric coating substances which are used for this purpose, such as Neoprene, natural or synthetic rubber, Nitrile rubber, Hycar and the like.

A typical technique for applying the coating 11 to the plastic 10 is shown in FIG. 2. Calender rollers 12, 13, 14 are rotated in the indicated directions and the sheet 10 is passed between the lower two rolls 12, 13. A chute 15 feeds the nip between the upper two rolls 13, 14 with liquid plastic which is then carried around the roll 13 and is deposited in a layer 11 over the surface of the base fabric 10. The plastic coating 11 is absorbed into the interstices of the fabric and forms a film thereover. If desired, the fabric web 10 can be passed through the calendering rolls several times, depending upon the thickness of the coating it is desired to apply thereto.

Before the plastic layer 11 is finally sealed to the base fabric 10, it is passed through the same or another set of calender rolls 16, 17, 18. Roll 17 is provided with end bands 19 of the desired thickness to leave a center shallow groove or channel 22 of a thickness equal to that of the desired belly band strip of plastic which is to be applied to the fabric. The chute 23 is provided with liquid substantially pure plastic fed into the nip between the two top rolls 17, 18 and substantially fills the channel 22 as calendered off by the top roll 18. Thus a strip 24 of substantially pure or all plastic is superimposed over the plastic coating 11 on the base web 10. Band strip 24 is applied in a layer in an elongated band or strip 24 longitudinally of the web 10. It is narrower than the web and is offset inwardly from the edges thereof. In the completed apron shown in FIG. 1, it extends completely across the apron from one side to the other.

I characterize the band 24 as substantially pure or all-plastic to differentiate it from the prior art patches which consist simply of another layer of fabric which is coated with plastic, whereas my layer or band 24 does not contain any fabric but is a relatively thick, pure or solid plastic layer which has great toughness and protective quality as compared to a patch which is made up largely of fabric. Moreover, although I use the term plastic, this is also intended to be a generic term including any elastomeric substance including rubber, as hereinbefore mentioned.

The calendering pressure of the rolls 16, 17 squeeze out all air voids between the band 24 and the coating 11 on the fabric 10 so there is an intimate interface between the band 24 and coating 11 throughout the contiguous areas thereof. If desired, a mineral dust may be applied to both top and bottom surfaces of the coated web. The web is then passed through an industrial heater or oven 25 in which heat is applied to heat seal, vulcanize and cure the various layers together with an intimate, virtually unbreakable bond therebetween. Oven 25 may contain heated rolls, radiant heaters, etc., over which the web passes in the course of the sealing step, this apparatus being generally conventional.

As issued from the heater 25, the web is in readiness for cutting into discrete apron shapes. Several such sheets may be stacked on top of one another prior to cutting, as desired. In any event, web 10 has one side margin die cut to remove semi-circular waste segments 26 at one side of the belly band 24, thus leaving bib portions 27 of successive aprons. The web 10 is then severed along transverse lines 28 which are spaced longitudinally along the web and this separates individual aprons as shown in FIG. 1 from the web 10. Web portions at the other side of band 24 from the bibs 27 constitute skirts 29.

The edges of the apron may then be hemmed at 31, provided with grommets at 32 and with a neck strap 33 and clasp 34, as is conventional. The resultant apron is shown in FIG. 1 and the belly band 24 extends completely across the apron. As shown in FIG. 1, the apron has various panel portions including a main panel below the bib 27 and which covers portions of the wearer and includes the re-enforcing panel or belly band 24 which overlies the top portion of the main panel in the area of the wearer's belly and a skirt panel 29 below the re-enforcing panel.

The application of a continuous belly band strip 24 to the web 10 as shown in FIG. 3 makes it possible to utilize a relatively wide web 10, and to cut the aprons along transverse lines 28. This speeds up fabrication, because the belly band 24 is laid down in a continuous strip. In the prior art method of fabricating aprons with the half-moon patches, the discrete aprons were typically cut end-to-end and from a narrower web. The semi-circular waste patches as cut from the web were then sewn or applied by a labor intensive procedure to the belly portion of the apron. The present method not only produces a better apron with greater protection, but also reduces labor costs because the belly band is applied to the base fabric in a continuous fabricating technique as illustrated in FIG. 3, not requiring manual labor.

What is claimed is:

1. A protective apron comprising a fabric base sheet having an over-all plastic coating, said sheet including a main panel covering portions of the wearer, a bib panel thereabove and a re-enforcing panel overlying the top portion of said main panel in the area of the wearer's belly, said re-enforcing panel comprising a belly band completely across the apron from one side to the other and comprising a top layer of substantially all plastic superimposed on the plastic coating of the base sheet fabric and laminated thereto throughout the contiguous areas thereof.

* * * * *